United States Patent [19]
Selesnick
[11] 4,254,646
[45] Mar. 10, 1981

[54] APPARATUS FOR CONTINUOUSLY CONTROLLING OF THE CLEANING OF SUEDE AND LEATHER GARMENTS

[76] Inventor: Michael M. Selesnick, 310 Prospect St., Trenton, N.J. 08618

[21] Appl. No.: 82,501

[22] Filed: Oct. 9, 1979

[51] Int. Cl.³ ..... C14C 1/00; D06F 29/00; F25J 5/00

[52] U.S. Cl. ..... 69/30; 62/12; 68/18 R

[58] Field of Search ..... 69/29, 30, 31, 32, 21; 68/18 R, 18 C; 202/160; 62/12 R

[56] References Cited

U.S. PATENT DOCUMENTS

| | | | |
|---|---|---|---|
| 3,915,808 | 10/1975 | Wilcox | 202/160 |
| 3,977,218 | 8/1976 | Zucchini | 68/18 R |
| 3,990,273 | 11/1976 | Scholten et al. | 69/30 |

*Primary Examiner*—Patrick D. Lawson
*Attorney, Agent, or Firm*—John J. Kane; Frederick A. Zoda; Albert Sperry

[57] ABSTRACT

A method and apparatus for continuously controlling of the cleaning of suede and leather garments comprising a plurality of tanks each containing a slightly different cleaning fluid. Each of the tanks is preferably continuously filtered for soluble impurities and is selectively communicable to a washing device into which is introduced the garments. An additional amount of cleaning fluid is added to the wash device approximately equal in weight to the weight of the garments to be washed. A further additional amount of cleaning fluid is added which is approximately proportional to the weight of the garments being washed. After washing, the remaining liquid is returned to the original tank. In this manner the tank will be refilled to the original level and will overflow through an overflow aperture in an amount approximately equal to the further added cleaning liquid. The overflowed cleaning liquid will then be gathered in a sump tank and be pumped to a holding tank and subsequently be distilled to remove pure solvent therefrom. This solvent will pass through a reclaiming line to a position where it may be mixed with cleaning additives in the proper amount in order to match one of the cleaning liquids within one of the plurality of tanks. This new mixture will now be added to the wash cylinder in an amount equal to or proportional to the weight of the garments therein and as such the cycle will be completed. In this fashion, a method and apparatus is disclosed for continuously maintaining the desired condition of the cleaning liquids when washing leather and suede garments.

15 Claims, 1 Drawing Figure

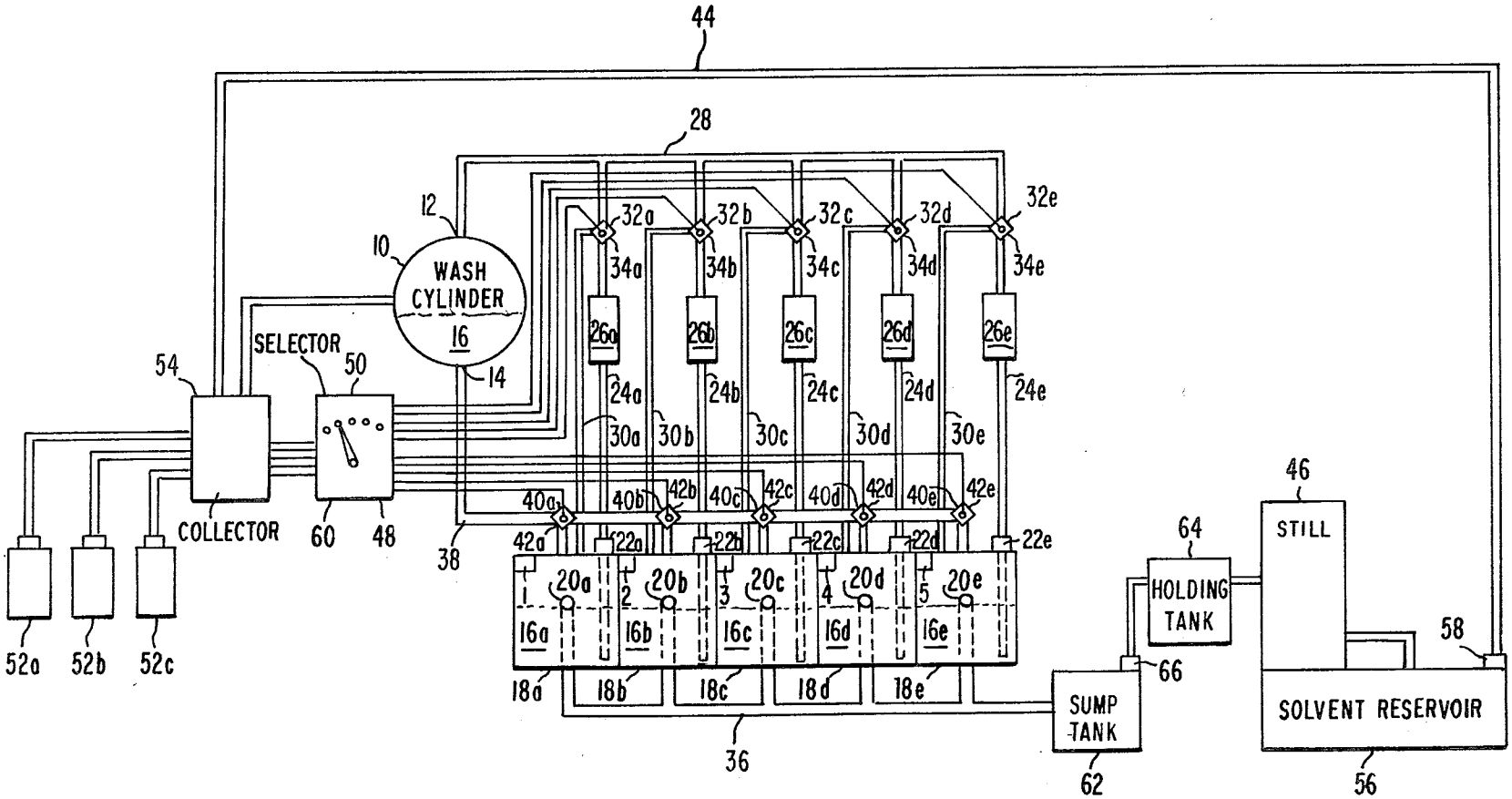
SOLVENT RESERVOIR
STILL
HOLDING TANK
SUMP TANK
WASH CYLINDER
SELECTOR
COLLECTOR

APPARATUS FOR CONTINUOUSLY CONTROLLING OF THE CLEANING OF SUEDE AND LEATHER GARMENTS

BACKGROUND OF THE INVENTION

1. Field of the Invention

Suede and leather cleaning is a very complex subdivision of the general textile cleaning industry. In the original tanning, the skins are treated with oils which tend to keep the skins soft and supple. Unfortunately these oils are soluble in dry cleaning solvents and if the leather is cleaned in the same manner as other textiles the oils will be removed causing the skins to lose the original supple characteristics. Also, because of direct sensitivity to heat, the dye stuffs used in leather cleaning are much more fugitive than those used in textile and, as such, a severe loss in original color is often the result of incorrect cleaning procedures.

Also, with the current new types of leather garments which are being introduced including calves skins, horse hides and sheep skins it is far more necessary to achieve close control of the cleaning solution since these new types of garments are much more sensitive to slight variations in the components of the cleaning mixture than the sheep skins which comprised approximately 90 percent of the leather garments made in the 1950's.

The present invention provides for the usage of a cleaning solvent which may be either of perchlorethylene or another conveniently available cleaning solvent. Cleaning additives will be mixed in varying amounts to the chosen cleaning solvent to provide the final cleaning liquid. Due to the great variety of leather garments now available, a plurality of cleaning liquids will be necessary. Each of these different cleaning liquids will include variable amounts of the cleaning additives in addition to the chosen solvent. The present invention shows a system utilizing five such baths.

2. Description of the Prior Art

The prior art devices in this field have commonly utilized multiple baths each one of which is adaptable to the cleaning of a particular class of leather or suede garments. Also, it is old in the art to continuously filter the impurities within each individual bath. It is also well known in the art to turn the liquid after completion of the washing to the particular tank from which the washing solution was originally obtained.

With such prior art devices a problem existed with respect to the quality control of the individual cleaning solution. Assuming that each bath was formed in the morning, by the end of the day the amount of fatty acids and other soluble and insoluble contaminants within the mixture would strongly inhibit the cleaning action of the cleaning liquid. The question of quality control was solely in the hands of the manual operator who upon visual inspection would determine that, for example, a new bath 4 should be mixed or, for example, half of a bath 2 should be drained and a new half portion inserted. Such hit or miss quality control is certainly not acceptable under the conditions of the current day with many more sensitive leather and suede garments.

Also, in addition to the question of quality control, the baths would continually be depleted in volume since a large amount of the solution would be retained within the garment after washing and spinning. On the average with leather and suede garments, 100 percent of the weight of the original garment will be retained in cleaning liquids within the garment itself when it is passed from the washing device into the dryer. This cleaning liquid is reclaimed at a later stage of the process, however for the purposes of the washing device it is lost until new baths are created on another day. Therefore, a system is required for continuously replenishing the amount of solution within each of the baths being utilized.

The present invention provides a system for continuous cleaning of soluble and insoluble impurities from each individual bath as well as for the replenishing of the volumes within the baths resulting from depletion by retention by the washed garments.

SUMMARY OF THE INVENTION

The present invention provides an apparatus and method for continuously controlling of the cleaning of suede and leather garments which includes a washing means which is adapted to receive garments to be cleaned. This wash means defines an inlet to receive cleaning liquid and an outlet to drain cleaning liquid therefrom.

A plurality of tank means each contains the original mixtures of cleaning liquids. Each of the tank means contains a slightly different composition of cleaning liquid which is particularly adaptable for usage in the washing of slightly varying types of leather and suede garments. Each of the tanks is selectively in fluid flow communication with the wash means to thereby supply the particularly desired cleaning liquid thereto. Each tank also includes an overflow aperture therein.

Each tank has an associated tank pump means which is preferably continuously operating to continuously pump liquid from the tank. The tank means is adapted to pump the liquid into a filtering line which includes a filtering means therein adapted to filter insoluble contaminants therefrom. At the end of the filtering line is located a bypass valve means. In the normal mode of operation the bypass valve means allows passage of the cleaning liquid from the filtering line immediately downstream of the filter means into a bypass line which returns the cleaning liquid directly to the tank from which it was pumped. Alternatively, if actuated, the bypass valve will be adapted to allow the cleaning liquid from the tank to be pumped into a supply line which is in direct fluid flow communication with the wash device. However, in the normal mode the washing liquid will merely be continuously circulated by the pump means through the filter in the filter line and through the bypass valve into the bypass line and be returned directly to the original tank.

After washing, the liquid will be allowed to drain through the outlet of the wash means into a return line which is in selective fluid flow communication with each of the tank means. A plurality of return valve means are positioned adjacent each tank means within the return line to selectively allow return of the cleaning liquid to the proper tank.

Each of the tanks preferably has an overflow aperture therein such that when the liquid therein reaches a predetermined level it will pass out of the tank into a drain line and be gathered preferably within a sump tank. A sump pump will pump the expelled cleaning liquid into a holding tank. The holding tank will then supply this liquid to a distillation means in which all of the liquids including contaminants and cleaning additives will be removed from the solvent and a relatively pure solvent will be gathered within a solvent reservoir. This solvent reservoir will then be the source of pure solvent which is pumped through a reclaiming line by a solvent pump.

A selector means is manually or otherwise movable between one of a plurality of locations corresponding to the number of tanks of varying cleaning liquid. As the selector is placed upon a given mode of operation, the corresponding bypass valves and return valves will have their operation initiated to cause the passage of the proper cleaning fluid into the wash cylinder. Preferably the bypass valves will each be operated by a bypass solenoid means and the return valves will each be operated by a return solenoid means. In this configuration the selector means will be electrically communicated to the various solenoids. When the selector means is placed at a given location, a time delay will be initiated for operation of the return valve and the corresponding bypass valve will be immediately initiated. This immediate initiation will allow the liquid from the corresponding tank to flow into the wash cylinder for washing. Once the predetermined wash period has been terminated the cleaning fluid will pass out of the outlet and be returned to the tank. At that time the time delay means within the selector means will cause operation of the return valve and the fluid will pass back into the proper tank.

A controller means such as an electronic controller means will be operably connected to a plurality of cleaning additives. The controller means will also be operably connected to a reclaiming line through which pure solvent is obtainable. The controller will also be operable to know the position of the selector means. This may be an actual electrical or mechanical interconnection between the controller and the selector or the controller itself may be manually movable to a position corresponding to the selector. With either mode of operation, the controller will be informed as to the mode of operation of the selector. In this configuration the controller will then add the proper amounts of the individual cleaning additives to the pure solvent to match the cleaning liquid within the particular tank being used for that particular washing operation. Also the controller will be provided manually or otherwise with the information as to the weight and type of the garment being placed within the wash cylinder. Therefore the controller will provide an amount of cleaning liquid equal in composition to the cleaning liquid being used in the particular selector mode in an amount equal to approximately 100 percent of the weight of the garment being washed as well as an additional amount of from one and a half to two and a half gallons per pound per 60 pounds of such garments.

After washing, the garments will retain approximately 100 percent of their weight in cleaning liquid. Since that amount of liquid was originally introduced the resulting amount of liquid within the tank will be approximately the same except it will be slightly greater in accordance with the ratio of one and half to two and a half pounds per 60 gallons of liquid. This additional liquid will cause approximately that amount of liquid to pass outward through the overflow apertures into the drain lines therebelow. This cleaning fluid will be gathered within the sump tank and will subsequently be distilled to thereby provide additional pure solvent within the solvent reservoir. The cleaning additives and other soluble and insoluble impurities are removed from the cleaning solution during distillation will usually be disgarded.

It is an object of the present invention to provide a means for continuously filtering cleaning fluids utilized in suede and leather garment cleaning.

It is an object of the present invention to provide a method and apparatus for continuously controlling the liquids used for the cleaning of suede and leather garments wherein a plurality of compositions of cleaning fluids is usable.

It is an object of the present invention to provide a method and apparatus for continuously controlling of the cleaning of suede and leather garments by the continuous replenishing of cleaning fluids retained by the washed garments.

It is an object of the present invention to provide a method and apparatus for continuously controlling of the cleaning of suede and leather garments whereby a predetermined amount of a particular cleaning liquid is automatically replenished and wherein the amount of such liquid automatically replenished is determined by the amount of garments washed therein.

It is an object of the present invention to provide a method and apparatus for continuously controlling of the cleaning of suede and leather garments wherein the expelled cleaning liquid is distilled to remove the cleaning solvent therefrom to provide a source of reclaimed pure solvent.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawing, in which:

FIG. 1 illustrates a schematic representation of an embodiment of the apparatus for continuously controlling of the cleaning of suede and leather garments of the present invention.

DETAILED DESCRIPTION OF THE PREFERRED EMBODIMENT

The present invention provides a means for the washing of suede and leather garments wherein the cleaning liquids are continuously controlled to maintain the quality thereof. The garments are initially placed within a wash means such as wash cylinder 10. A cleaning liquid is inserted into the wash means through inlet 12. Subsequent to washing, the cleaning liquid is gathered by the passage out of the wash means through an outlet 14.

The cleaning liquids 16*a* through 16*e* are selectively held within a tank means 18*a* through 18*e*. Within various systems a different number of tank means 18 can be provided from one or two to any desired number depending on the number of types of different leathers and suedes to be cleansed by the apparatus.

A plurality of tank pump means 22*a, b, c, d,* and *e* are placed in associated with the respective tank means 18*a, b, c, d,* and *e*. Each of these tank pump means 22 are adapted to pump the cleaning liquid 16 from the tank means 18 into a filtering line 24 such as lines 24*a, b, c, d,* and *e*. Each filtering line 24 includes a filter means 26 therein which is adapted to preferably filter out the insoluble impurities therefrom. Preferably at the end of the filter line 24 is located a bypass valve means 32. The bypass valve means is selectively in fluid flow communication with either a bypass line 30 which extends back into the tank means 18 or the supply line 28. In the normal operating condition the bypass valve means 32 allows fluid flow communication between the end of the filter line 24 and the bypass lines 30. In this manner by continuous operation of the tank pump means 22 the cleaning liquid 16 within the tank means 18 will be continuously filtered for insoluble impurities by passage through the filter means 26. Preferably, the bypass valve means 32 will be caused to operate by actuation of a bypass solenoid means 34. Again in the normal operating condition fluid flow communication through the bypass valve means 32 will be from the filtering line 24 to the bypass line 30. However, when the solenoid means 34 is actuated, or the bypass valve means 32 is actuated, the bypass valve means 32 will provide fluid flow communication no longer to the bypass line 30. Instead fluid flow communication will be created between the filter lines 24 and the supply line 28. Cleaning liquid will then pass through the supply line 28 directly into the wash means 10.

At this point the leather and suede garments to be cleaned will also be placed in the wash means and the washing step itself will take place.

After washing the cleaning liquids will be passed outwardly through the outlet 14 of wash means 10 into a return line 38. This return line will be selectively in fluid flow communication with all of the tank means 18 of the particular device. The return line will actually include a plurality of return valve means 40*a, b, c, d,* and *e* therein. Each of these return valve means is selectively communicable therein to one of the respective tank means 18*a* through 18*e*. The apparatus will be controlled in such a manner that the previously actuated bypass valve means 32 will correspond with the subsequently actuated return valve means 40 such that the washing fluid will return to the original tank means 18 thereof. If an additional amount of fluid is introduced into the tank means 18 above and beyond that amount of liquid originally withdrawn therefrom for the cleaning operation, an overflow condition will be created within the tank means such that liquid will pass outward through the overflow aperture 20 and into the drain line 36. A sump tank 62 may be positioned to receive the liquid that has passed through drain line 36. A sump pump 66 may also be included to pump the liquid from the sump tank into a holding tank 64.

Holding tank 64 is directly connected to a distillation means 46. The distillation means is adapted to distill the cleaning liquid supplied thereto and in this manner separate the solvent from the soluble and insoluble impurities therein as well as to separate the solvent from the cleaning fluids still remaining therein. In this manner a pure solvent will be obtained and will be passed into the solvent reservoir 56. A solvent pump 58 will remove the solvent from solvent reservoir 56 and pump it into a reclaiming line 44. In this manner reclaiming line 44 will provide a source of pure solvent for the formulation of new cleaning liquid.

Each of the return valve means 40*a, b, c, d,* and *e* is preferably actuated by a return solenoid means 42 and in this manner an electrical actuation thereof is made possible. As shown in the embodiment in FIG. 1 the solenoid 40*a* will be in a normally open position in the horizontal direction and will normally be closed to the passage of liquid downwardly into the cylinder 1. The return valve means 40*b, c, d,* and *e* will all be configured in the same manner. Therefore, when the return of a particular liquid to a particular tank means 18 is required that chosen return solenoid means 42 will be actuated and the return valve means 40 will be opened and allow the passage of cleaning liquid back into the corresponding tank means 18.

The present invention preferably includes a selector means 48 which includes a dial 50 thereon which possibly may be manually movable from one mode of operation to another. Each mode of operation corresponds to the desire to use a particular composition of cleaning liquids found within the different tank means 18. For example, if usage of the particular composition of cleaning liquids 16*c* within tank means 18*c* is required the selector will be placed on the number 3 position. The selector 48 will then be operable to initially open, perhaps electrically, the bypass valve means 32*c*. At this time the cleaning liquid 16*c* will pass through the supply line 28 into the wash cylinder 10. The washing operation will take place. After the washing operation the liquid 16*c* will pass outward through the outlet 14 into the return line 38. The liquid will pass through the horizontally open valve 40*a* and the horizontally open valve 40*b*. Valve 42*c* will be operated by a time delay means 60 located within the selector 48 to initiate the opening thereof a certain time period after the opening of the corresponding bypass valve 32*c*. At this point the liquid will be reintroduced into the tank means 18*c*.

However, when leather and suede garments are washed a high amount of the cleaning liquid is retained within the garment itself. On the average the weight of the leather and suede garment is increased 100 percent even after the spinning within the wash cylinder. In order to maintain the quality and level of liquid within the tanks a controller 54 is included in the present invention. This control means 54 is operably connected to a plurality of cleaning additive reservoirs 52*a,* 52*b,* and 52*c*. The number of additives normally will be three but could be any number for the present invention. Preferably the selector is electrically or otherwise connected to the controller to indicate to the controller 54 what mode of operation the selector is currently utilizing. Having had this information communicated to the controller 54 the controller will know exactly what proportions of additives 52*a,* 52*b,* and 52*c* to mix with the pure solvent being supplied through reclaiming line 44 to actually compose a cleaning fluid which matches that cleaning fluid currently being utilized within the wash cylinder 10. Alternatively, the controller could have a manual adjustment which the operator would set to match the position of the selector, however, and electrical communication between the controller 54 and the selector 48 is preferable.

After the cleaning liquid has been passed from the tank means into the wash cylinder 10 the controller will be operable to introduce an amount of additional matching cleaning fluid approximately equal to the weight of the garments to be washed. In this manner the amount of liquid retained by the garments will be replaced by the controller 54 and the level of fluids within the tanks 18*a, b, c, d,* and *e* will be maintained. However, in order to provide some cleansing of the soluble impurities, it is always desirable to distill a proportion of the liquids within the tanks. The amount of liquids which must be distilled in order to be maintained below the quality control level of insoluble impurities is directly proportional to the amount of garments being washed by that particular cleaning liquid. Therefore, the controller 54 is adapted to add an additional amount of liquid above the 100 percent weight level of the washed garments in order to provide an overflow through the respective overflow apertures 20*a* through 20*e*. The amount of additionally introduced cleaning fluid will be directly proportional to the weight of the garments being washed and will depend somewhat on which bath is being used. For example, the average additionally introduced cleaning fluid will be 2 gallons for every 60 pounds of garments being washed. This two gallons may be as low as one and a half or as high as two and a half, this depends upon the particular washing solution being used. In other words, the particular class of garments usable for the different cleaning fluids within the tanks varies the amount of distillation required. That is, the washing of some classes of garments requires more distillation than others. Therefore, the controller will introduce this slight additional amount of cleaning liquid. After the washing is completed and the cleaning liquid has been returned to the particular tank means 18 the additionally introduced cleaning liquid will cause the passage of exactly that amount of cleaning liquid outward through the respective overflow aperture 20*a* through 20*e*. This liquid will then pass through the drain line 36 to provide exactly that amount of additional distillation within distillation means 46 and will provide new pure solvent into the solvent reservoir 56.

In this manner the present invention provides a method and apparatus for controlling the level of cleaning fluid within individual tank means within an overall compound washing system. Also the present invention provides a means of controlling the quantity as well as the quality of material within the individual tank means of a compound system by continuously filtering the tanks for insoluble impurities and by filtering the tanks for insoluble impurities and other contaminants directly proportional to the weight of leather and suede materials being washed.

While particular embodiments of this invention have been shown in the drawing and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An apparatus for continuously controlling of the cleaning of suede and leather garments comprising:

(a) a wash means adapted to receive garments to be cleaned therein, said wash means defining an inlet and an outlet therein to receive and expel cleaning liquids;

(b) a plurality of tank means each containing cleaning liquids therein and each being selectively in fluid flow communication with said wash means to supply cleaning liquid thereto, each tank means defining an overflow aperture therein;

(c) a plurality of tank pump means each one being associated with a tank means and adapted to pump the cleaning liquid therefrom;

(d) a plurality of filtering means each one being associated with a tank means and its associated tank pump means, each filter line being connected in fluid flow communication to said tank pump means, each filtering line including a filter means therein adapted to filter contaminants from the cleaning liquid;

(e) a supply line in direct fluid flow communication with said inlet of said wash means;

(f) a plurality of bypass lines in direct fluid flow communication with an associated tank means;

(g) a plurality of bypass valve means each one being associated with a filtering line and in direct fluid flow communication to the end thereof downstream of said filtering means, each bypass valve being connected to an associated bypass line and being connected to said supply line, said bypass valve means being always open to said filtering line and normally open to said bypass line to allow passage of cleaning liquid from said tank means via said filtering line and through said filtering means into said bypass line to return to said tank means to effect removal of contaminants from the cleaning liquid, said bypass valve means being responsive when actuated to become open with respect to said supply line and closed with respect to said bypass line to supply cleaning liquid to said inlet of said wash means from said filtering line;

(h) a drain line in fluid flow communication with said overflow apertures of said tank means to receive overflow of cleaning liquids from said tank means;

(i) a distillation means in fluid flow communication with said drain line to receive cleaning liquid therefrom to distill same and remove solvent therefrom;

(j) a reclaiming line in fluid flow communication with said distillation means to receive reclaimed solvent therefrom;

(k) a return line in fluid flow communication with said outlet of said wash means to receive cleaning liquid therefrom after completion of the washing cycle;

(l) a plurality of return means located within said return line each being associated with a given tank means, said return valves each being normally closed with respect to the associated tank means and being responsive when actuated to open to receive the cleaning liquid returning from said wash means;

(m) a selector means being movable to a plurality of modes of operation wherein each mode corresponds to cleaning of garments within said wash means with one of the cleaning liquids of one of said tank means, said selector means being operably connected to the plurality of said return valve means and each associated bypass valve means, said selectormeans being responsive in a given mode of operation to actuate said corresponding bypass valve means and said corresponding return means to cause washing within that given mode;

(n) a plurality of cleaning additive reservoirs each containing a cleaning additive to be added in varying amounts to the solvent to provide the cleaning liquids in each of said tank means; and (o) a controller means adapted to receive controlled amounts of cleaning additives from said cleaning additive reservoirs and adapted to receive pure solvent from said reclaiming lines to provide cleaning liquid to said wash means in addition to the cleaning liquid provided thereto through said supply line, said selector means being operably connected to said controller means whereby said controller means is responsive to the mode of operation of said selector means to provide said wash means with a mixture of solvent and cleaning additives corresponding to the cleaning liquid of the current mode of operation thereof, said controller means being operable to inject sufficient additional cleaning liquid to replace that lost in the washing and further additional cleaning liquid to assure some overflow to said overflow aperture of said associated tank means to cause flow to said distillation means through said drain line.

2. The apparatus as defined in claim 1 wherein said controller means provides an amount of additional cleaning liquid at least greater in weight than the weight of the garments washed.

3. The apparatus as defined in claim 1 wherein said controller means provides an amount of additional cleaning liquid equal to the weight of the garment by being washed in addition to another amount of additional cleaning liquid proportional to the weight of the garments being washed to cause flow of cleaning liquid through the overflow aperture of said associated tank means.

4. The apparatus as defined in claim 1 wherein said selector means is movable manually to each mode of operation.

5. The apparatus as defined in claim 1 wherein said bypass valve and said return valves comprise solenoid means electrically controlled by said selector means.

6. The apparatus as defined in claim 1 wherein said plurality of tank pumps are continuously operating to pump cleaning liquid from said tank means through said associated filtering line and back into said tank means through said bypass line to continuously filter the cleaning solution even when said associated bypass valve is in the normal unactuated position.

7. The apparatus as defined in claim 1 further comprising a solvent reservoir positioned downstream of said distillation means and in fluid flow communication with said reclaiming line, said solvent reservoir being adapted to receive and hold pure solvent from said distillation means to be supplied to said reclaiming line.

8. The apparatus as defined in claim 7 further comprising a solvent pump positioned between said solvent reservoir and said reclaiming line.

9. The apparatus as defined in claim 1 wherein said controller means is electronic.

10. The apparatus as defined in claim 1 wherein said plurality of filtering means are operable to remove insoluble impurities from the cleaning liquid.

11. The apparatus as defined in claim 1 wherein said distillation means separates cleaning solvent at least from insoluble impurities and cleaning additives to provide pure solvent to said controller means through said reclaiming line.

12. The apparatus as defined in claim 1 wherein said selector means when put in a given mode of operation is responsive to actuate the corresponding one of said bypass valves to supply cleaning liquid for washing, said selector means further including a time delay means operable to actuate the corresponding one of said return valves after a predetermined wash time period to allow return of the remaining cleaning liquid to the associated one of said tank means.

13. The apparatus as defined in claim 1 comprising exactly five of said tank means, five of said filtering lines, five of said filter means, five of said tank pumps, five of said bypass lines, five of said bypass valves and five of said return valves to provide five different mixtures of cleaning liquid formed of solvents and cleaning additives within said five tank means.

14. An apparatus for continuously controlling of the cleaning of suede and leather garments comprising:

(a) a wash means adapted to receive garments to be cleaned therein, said wash means defining an inlet and an outlet therein to receive and expel cleaning liquids;

(b) a plurality of tank means each containing cleaning liquids therein and each being selectively in fluid flow communication with said wash means to supply cleaning liquid thereto, each tank means defining an overflow aperture therein;

(c) a plurality of continuously operating tank pump means each one being associated with a tank means and adapted to pump the cleaning liquid therefrom;

(d) a plurality of filtering means each one being associated with a tank means and its associated tank pump means, each filter line being connected in fluid flow communication to said tank pump means, each filtering line including a filter means therein adapted to filter insoluble contaminants from the cleaning liquid;

(e) a supply line in direct fluid flow communication with said inlet of said wash means;

(f) a plurality of bypass lines in direct fluid flow communication with an associated tank means;

(g) a plurality of bypass valve means, each including a bypass solenoid means, each one being associated with a filtering line and in direct fluid flow communication to the end thereof downstream of said filtering means, each bypass valve being connected to an associated bypass line and being connected to said supply line, said bypass valve means being always open to said filtering line and normally open to said bypass line to allow passage of cleaning liquid from said tank means via said filtering line and through said filtering means into said bypass line to return to said tank means to effect removal of contaminants from the cleaning liquid, said bypass valve means being responsive when actuated to become open with respect to said supply line and closed with respect to said bypass line to supply cleaning liquid to said inlet of said wash means, said plurality of tank pumps being continuously operating to pump cleaning fluid from each of said tank means through said associated filtering line and back into said tank means through said associated bypass line to continuously filter the cleaning solution within each tank means even when said associated bypass valve is in the normally unactuated position;

(h) a drain line in fluid flow communication with said overflow apertures of said tank means to receive overflow of cleaning liquids from said tank means;

(i) a distillation means in fluid flow communication with said drain line to receive cleaning liquid therefrom to distill same and remove solvent therefrom;

(j) a reclaiming line in fluid flow communication with said distillation means to receive reclaimed solvent therefrom;

(k) a solvent reservoir positioned downstream of said distillation means and in fluid flow communication with said reclaiming line, said solvent reservoir being adapted to receive and hold pure solvent from said distillation means to be supplied to said reclaiming line;

(l) a solvent pump positioned to clean said solvent reservoir and said reclaiming line and being adapted to pump pure solvent from said solvent reservoir through said reclaiming line;

(m) a return line in fluid flow communication with said outlet of said wash means to receive cleaning liquid therefrom after completion of the washing cycle;

(n) a plurality of return means, each including a return solenoid means, located within said return line each being associated with a given tank means, said return valves each being normally closed with respect to the associated tank means and being responsive when actuated to open to receive the cleaning liquid returning from said wash means;

(o) a selector means being movable to a plurality of modes of operation wherein each mode corresponds to the cleaning of garments within said wash means with one of the cleaning liquids of one of said tank means, said selector means being operably connected to the plurality of said return solenoid means of said return valve means and to a plurality of return solenoid means of each associated bypass valve means, said selector means being responsive in a given mode of operation to actuate said corresponding bypass valve means and said corresponding return means to cause washing within that given mode, said selector means being operable when placed into a given mode of operation to actuate the corresponding one of said bypass valves to supply cleaning liquid for washing through said reclaiming lines to said wash means, said selector means further including a time delay means operable to actuate the corresponding one of said bypass valves to supply cleaning liquid for washing through said reclaiming line to said wash means, said selector means further including a time delay means operable to actuate the corresponding one of said return valves after a predetermined wash time period to allow return of the remaining cleaning liquid to the associated one of said tank means through said drain line;

(p) a plurality of cleaning additive reservoirs each containing a cleaning additive to be added in varying amounts to the solvent to provide the cleaning liquids in each of said tank means;

(q) a controller means being electronic and adapted to receive controlled amounts of cleaning additives from said cleaning additive reservoirs and adapted to receive pure solvent from said reclaiming lines to provide cleaning liquid to said wash means in addition to the cleaning liquid provided thereto through said supply line, said selector means being operably connected to said controller means whereby said controller means is responsive to the mode of operation of said selector means to provide said wash means with a mixture of solvent and cleaning additives corresponding to the cleaning liquid of the current mode of operation thereof, said controller means being operable to inject sufficient additional cleaning liquid to replace that lost in the washing and further additional cleaning liquid proportional to the weight of the garment being washed to assure some overflow through said overflow aperture of said associated tank means to cause flow to said distillation means through said drain line.

15. The apparatus as defined in claim 14 comprising exactly five of said tank means, five of said filtering lines, five of said filter means, five of said tank pumps, five of said bypass lines, five of said bypass valves and five of said return valves to provide five different mixtures of cleaning liquids formed of solvents and cleaning additives within said five tank means.

* * * * *